US009039346B2

(12) United States Patent
Muralidharan et al.

(10) Patent No.: US 9,039,346 B2
(45) Date of Patent: May 26, 2015

(54) ROTOR SUPPORT THERMAL CONTROL SYSTEM

(75) Inventors: Vasanth Muralidharan, Bangalore (IN); Sulficker Ali, Bangalore (IN); Amarnath Kakarla, Prakasam (IN); Hemanth Gudibande Sathyakumar Kumar, Bangalore (IN)

(73) Assignee: General Electric Company, Schenectady, NY (US)

( * ) Notice: Subject to any disclaimer, the term of this patent is extended or adjusted under 35 U.S.C. 154(b) by 869 days.

(21) Appl. No.: 13/275,197

(22) Filed: Oct. 17, 2011

(65) Prior Publication Data

US 2013/0094947 A1 Apr. 18, 2013

(51) Int. Cl.

| | |
|---|---|
| ***F01D 25/16*** | (2006.01) |
| ***F01D 25/14*** | (2006.01) |
| ***F01K 7/16*** | (2006.01) |

(52) U.S. Cl.

CPC ..... *F01D 25/14* (2013.01); *F01D 25/162* (2013.01); *F01K 7/165* (2013.01)

(58) Field of Classification Search

CPC ..... F01K 7/165

See application file for complete search history.

(56) References Cited

U.S. PATENT DOCUMENTS

| | | | | |
|---|---|---|---|---|
| 5,147,015 | A * | 9/1992 | Snuttjer et al. | 184/6.22 |
| 5,281,085 | A | 1/1994 | Lenahan et al. | |
| 6,308,776 | B1 | 10/2001 | Sloan et al. | |
| 6,854,514 | B2 | 2/2005 | Sloan et al. | |
| 2001/0047864 | A1 | 12/2001 | Sloan et al. | |
| 2005/0069406 | A1 | 3/2005 | Turnquist et al. | |
| 2010/0054927 | A1* | 3/2010 | Almstedt et al. | 415/180 |
| 2010/0187180 | A1* | 7/2010 | Baten | 210/718 |
| 2010/0284795 | A1 | 11/2010 | Wadia et al. | |
| 2011/0002774 | A1 | 1/2011 | Karafillis et al. | |
| 2011/0020116 | A1* | 1/2011 | Hashimoto et al. | 415/180 |

FOREIGN PATENT DOCUMENTS

| | | | |
|---|---|---|---|
| CA | 2007633 | | 3/2000 |
| CA | 2686370 | | 6/2010 |
| CA | 2481971 | | 7/2010 |
| EP | 0563054 | B1 | 4/1995 |
| EP | 2208862 | A2 | 7/2010 |
| EP | 2218880 | A1 | 8/2010 |
| EP | 2224099 | A2 | 9/2010 |
| EP | 1918525 | A3 | 10/2010 |
| EP | 2236772 | A2 | 10/2010 |
| GB | 2467893 | | 11/2008 |
| JP | 59113210 | | 6/1984 |
| WO | 9211444 | | 7/1992 |
| WO | 2010136014 | A2 | 12/2010 |
| WO | 2010136018 | A2 | 12/2010 |
| WO | 2010136018 | A3 | 12/2010 |

* cited by examiner

*Primary Examiner* — Nathaniel Wiehe
*Assistant Examiner* — Jeffrey A Brownson
(74) *Attorney, Agent, or Firm* — Ernest G. Cusick; Hoffman Warnick LLC

(57) ABSTRACT

Systems for thermally regulating portions of a steam turbine are disclosed. In one embodiment, a thermal control system for a rotor bearing support includes: a housing fluidly connected to an inlet and adapted to substantially enclose the rotor bearing support, the housing defining a first annular cavity adapted to receive a fluid from the inlet; and an outlet fluidly connected to the housing, the outlet adapted to receive the fluid from the annular cavity.

16 Claims, 7 Drawing Sheets

ROTOR SUPPORT THERMAL CONTROL SYSTEM

BACKGROUND OF THE INVENTION

The subject matter disclosed herein relates to turbines and, more particularly, to systems for controlling the thermal condition of a steam turbine rotor support, specifically a rotor bearing support.

Some power plant systems, for example certain nuclear, simple cycle and combined cycle power plant systems, employ turbines in their design and operation. Some of these turbines include rotating portions (e.g., rotors) which are supported by rotor bearing supports within the turbine. These rotor bearing supports stabilize a position of the rotors and enable the rotors to be rotatable within the turbine. During operation, a working fluid (e.g., high temperature steam, high temperature gas, etc.) is directed through the turbine and across a length of the rotor; this working fluid driving the rotor to produce power for a variety of applications. Some of these rotors may have a substantial length which requires the use of multiple rotor bearing supports within the turbine. The location and proximity of the rotor bearing supports to the rotor may result in exposure to substantial thermal gradients. With differences in these thermal gradients ranging in the hundreds to thousands of degrees Celsius, the rotor bearing supports may significantly expand and contract in response to the temperature variations which occur during operation of the turbine. These expansions and contractions may adjust a height of the rotor bearing supports and subsequently a position of the rotor, requiring the turbine to include increased radial clearances between the rotor and turbine which may decrease system efficiency. Further, in turbines with lengthy rotors requiring multiple rotor bearing supports, variations in thermal conditions throughout the rotor may cause differential thermal variations between each of the rotor bearing supports, resulting in misalignment of the rotor.

Referring to FIG. 1, a schematic view of portions of a turbine 100 is shown with a rotor 104 supported within a portion of a casing 130 by first rotor bearing support 120 and second rotor bearing support 122. Turbine 100 illustrated in FIG. 1 is a known turbine which is shown during operation exposed to a thermal gradient TG. Thermal gradient TG represents varying thermal conditions within turbine 100 which decrease incrementally in temperature from first rotor bearing support 120 toward rotor bearing support 122, with respect to the axial position. As shown in FIG. 1, thermal gradient TG is greater at first rotor bearing support 120 which is positioned axially downstream of rotor bearing support 122. As can be seen, casing 130, which is supported by a casing support 133 has an aligned/linear shape. In contrast, rotor bearing supports 120 and 122 have expanded as a result of exposure to thermal gradient TG, and these expansions have caused rotor 104 to partially deform in a non-linear manner. Furthermore, as a result of temperature variations across thermal gradient TG, rotor bearing support 120 has expanded to a greater height than rotor bearing support 122 resulting in a further misalignment of rotor 104.

BRIEF DESCRIPTION OF THE INVENTION

Systems for shielding and cooling turbine components are disclosed. In one embodiment, a thermal control system for a rotor bearing support includes: a housing fluidly connected to an inlet and adapted to substantially enclose the rotor bearing support, the housing defining a first annular cavity adapted to receive a fluid from the inlet; and an outlet fluidly connected to the housing, the outlet adapted to receive the fluid from the annular cavity.

A first aspect of the disclosure provides a thermal control system for a rotor bearing support including: a housing fluidly connected to an inlet and adapted to substantially enclose the rotor bearing support, the housing defining a first annular cavity adapted to receive a fluid from the inlet; and an outlet fluidly connected to the housing, the outlet adapted to receive the fluid from the annular cavity.

A second aspect provides a turbine bucket including: a stator; a rotor substantially enclosed within the stator; a set of rotor bearings connected to the rotor; a first rotor bearing support connected to a first portion of the set of rotor bearings; a second rotor bearing support connected to a second portion of the set of rotor bearings; and a thermal control system connected to the first rotor bearing support, the thermal control system comprising: an inlet; a housing fluidly connected to the inlet and adapted to substantially enclose the rotor bearing support, the housing defining a first annular cavity adapted to receive a fluid from the inlet; and an outlet fluidly connected to the housing, the outlet adapted to receive the fluid from the annular cavity.

A third aspect provides a power generation system including: a generator; a turbine operatively connected to the generator; a rotor disposed within the turbine; a set of rotor bearings connected to the rotor; a first rotor bearing support connected to a first portion of the set of rotor bearings; a second rotor bearing support connected to a second portion of the set of rotor bearings; and a thermal control system connected to the first rotor bearing support, the thermal control system comprising: an inlet; a housing fluidly connected to the inlet and adapted to substantially enclose the rotor bearing support, the housing defining a first annular cavity adapted to receive a fluid from the inlet; and an outlet fluidly connected to the housing, the outlet adapted to receive the fluid from the annular cavity.

BRIEF DESCRIPTION OF THE DRAWINGS

These and other features of this invention will be more readily understood from the following detailed description of the various aspects of the invention taken in conjunction with the accompanying drawings that depict various embodiments of the invention, in which.

Figure 1:
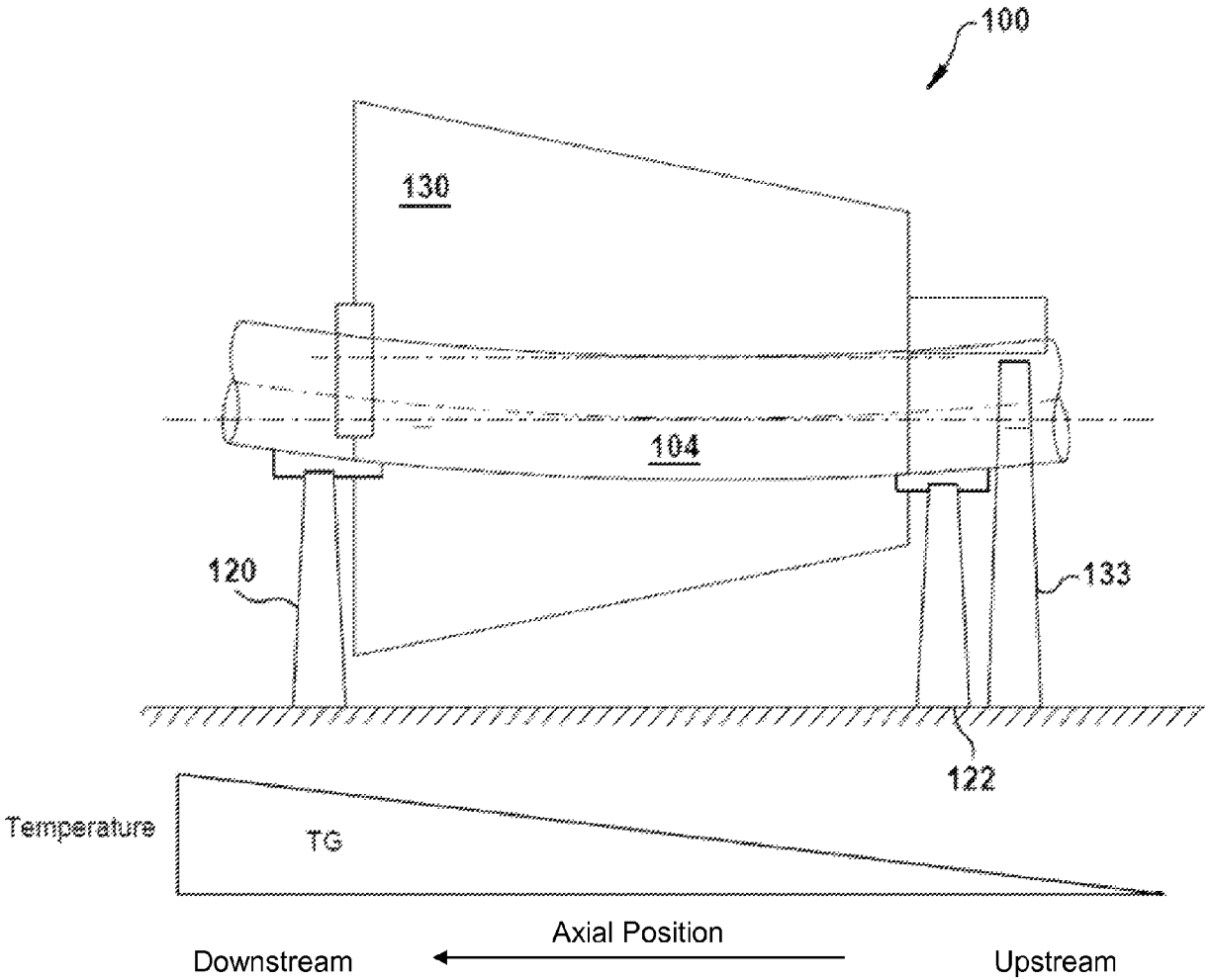
FIG. 1 shows a partial cut-away schematic view of portions of a turbine.
Figure 2:
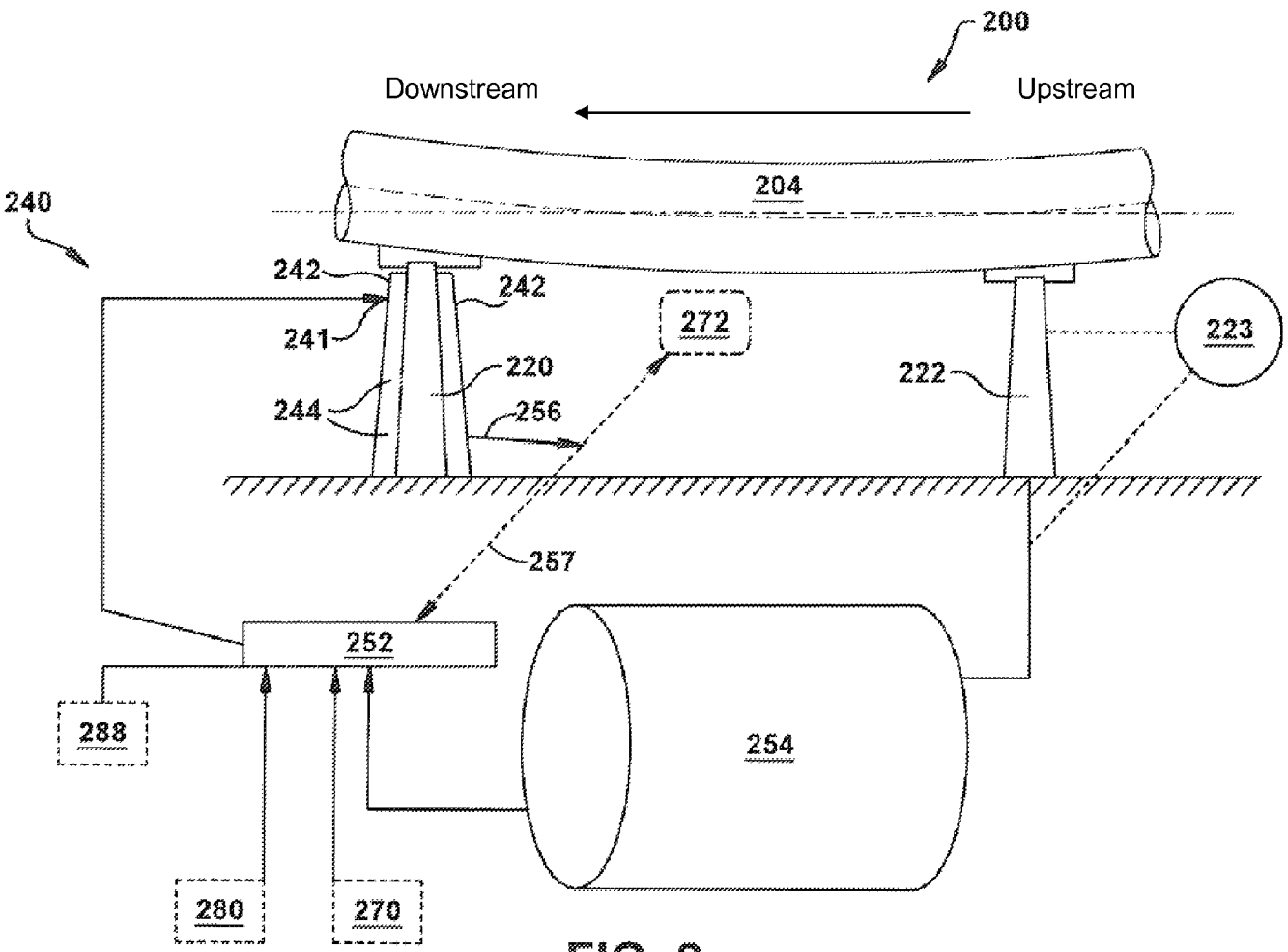
FIG. 2 shows a partial cut-away schematic view of portions of a turbine according to an embodiment of the invention.

It is noted that the drawings of the disclosure are not necessarily to scale. The drawings are intended to depict only typical aspects of the disclosure, and therefore should not be considered as limiting the scope of the disclosure. In the drawings, like numbering represents like elements between the drawings.

DETAILED DESCRIPTION OF THE INVENTION

As indicated herein, aspects of the invention provide for systems adapted to monitor and regulate a set of thermal conditions about and within a rotor support. These systems employ a housing adapted about the rotor support and operatively connected to a fluid system, the fluid system supplying adjustable quantities of a thermally controlled fluid to the housing, thereby thermally monitoring and regulating thermal conditions within and about the rotor support.

In the art of power generation systems (including, e.g., nuclear reactors, steam turbines, gas turbines, etc.), turbines driven by high temperature fluids (e.g., steam) are often employed as part of the system. The high temperature steam is directed through the turbine, thereby rotating a rotor and converting thermal energy into mechanical energy. However, the high temperature steam may have negative effects on certain components of the turbine such as the rotor and the rotor support, increasing the maintenance cost of the system and significantly reducing the efficiency and lifespan of the rotor. The rotors in some turbines are supported by multiple rotor bearing supports. Thermal conditions within the turbine may vary significantly during operation, causing these rotor bearing supports to expand and contract differentially. The expansion and contraction of the rotor bearing supports caused by these thermal variations may cause the rotor to bow or misalign within the turbine, reducing the efficiency of the system, wearing and/or damaging components and requiring excessive radial tolerances or clearances to be designed into the turbine.

Embodiments of the current invention provide for systems and devices adapted to protect portions of a turbine system from deformities and damage due to exposure to thermal variations by using a thermal control system to regulate and limit exposure of turbine components to thermal variations. The thermal control system includes a housing which is adapted about a rotor support of the turbine system. The housing is fluidly connected to a fluid system which supplies a thermal fluid (e.g., low temperature steam, air, condensate, water, oil, gas, etc.) to the housing. The low temperature steam travels through the housing and about the rotor support, thereby thermally insulating and regulating a temperature of the rotor support.

Turning to the FIGURES, embodiments of a thermal control system are shown, where the thermal control system may impact the efficiency and increase the life expectancy of the rotor, the turbine and the overall power generation system by thermally insulating and regulating the rotor supports. Each of the components in the FIGURES may be connected via conventional means, e.g., via a common conduit or other known means as is indicated in FIGS. 1-7. Specifically, referring to FIG. 2, a partial cross-sectional view of a turbine 200 is shown according to embodiments of the invention. Turbine 200 may include a rotor 204 partially supported by a first rotor bearing support 220 and a second rotor bearing support 222. First rotor bearing support 220 is substantially shielded by a thermal control system 240 which is fluidly connected to a fluid system 252. Thermal control system 240 includes a housing 242 positioned to shield first rotor bearing support 220 from exposure to environmental forces and/or conditions. Housing 242 defines an annular cavity 244 about first rotor bearing support 220 which is adapted to receive, circulate and/or release a thermal fluid (e.g., oil, condensate, water, etc.) received from fluid system 252. This thermal fluid absorbing and/or supplying heat to first rotor bearing support 220 and thermal control system 240, thereby thermally regulating first rotor bearing support 220.

In an embodiment of the invention, fluid system 252 may be operatively connected to a control system 254. Control system 254 may be a feedback control system, a user operated control system or any other form of control system known in the art. In one embodiment, control system 254 may regulate a quantity of the thermal fluid supplied to thermal control system 240. In another embodiment, control system 254 may regulate a temperature of the thermal fluid in fluid system 252. In one embodiment, control system 254 may be communicatively connected to a sensor 223 (e.g., a thermometer, a displacement sensor, etc.) connected to second rotor bearing support 222. In one embodiment, sensor 223 may monitor a temperature of second rotor bearing support 222 and transmit the temperature to control system 254. In another embodiment, sensor 223 may monitor expansion, contraction and/or deformities of second rotor bearing support 222. In one embodiment, control system 254 may adjust a temperature of the thermal fluid in fluid system 252 based upon conditions/readings (e.g., a temperature) of second rotor bearing support 222 obtained by sensor 223. In one embodiment, control system 254 may adjust a temperature of the thermal fluid in fluid system 252 based upon conditions detected within second rotor bearing support 222. In one embodiment, sensor 223 may monitor a temperature of oil flooding the mid-standard bearing support of second rotor bearing support 222. In another embodiment, sensor 223 may monitor growth of second rotor bearing support 222. Control system 254 may adjust a temperature of thermal fluid in fluid system 252 based upon the calculated thermal growth of second rotor bearing support 222, wherein the thermal growth is calculated using temperature measurements from sensor 223. In one embodiment, control system 254 adjusts a temperature of the thermal fluid so as to substantially match growth of first rotor bearing support 220 with growth of second rotor bearing support 222, thereby maintaining a complementary height between first rotor bearing support 220 and second rotor bearing support 222.

In one embodiment of the invention, the thermal fluid is introduced into annular cavity 244 via an inlet 241, and then returned to fluid system 252 via an outlet 256 and a return conduit 257 (shown in phantom). In another embodiment, the thermal fluid is circulated through annular cavity 244 and then released to ambient via outlet 256. In one embodiment, the thermal fluid may comprise lube oil from a main lube oil system 280 (shown in phantom) of turbine 200. Main lube oil system 280 supplies lube oil to thermal control system 240 via inlet 241, the lube oil flowing through thermal control system 240 and being released back to main lube oil system 280 via outlet 256. In another embodiment, the thermal fluid may comprise condensate from a condenser 270 (shown in phantom) of turbine 200. Condenser 270 supplying condensate to thermal control system 240 via inlet 241, the condensate flowing through thermal control system 240 and being released back to a condensate feed pump 272 (shown in phantom) via outlet 256. In another embodiment, the thermal fluid may comprise a gas (e.g., air, nitrogen, etc.) from a compressor 288 (shown in phantom). Compressor 288 supplies a gas which is temperature and/or pressure controlled to thermal control system 240 via inlet 241. In one embodiment, thermal control system 240 may be adapted about both rotor bearing support 220 and rotor bearing support 222.

Figure 3:
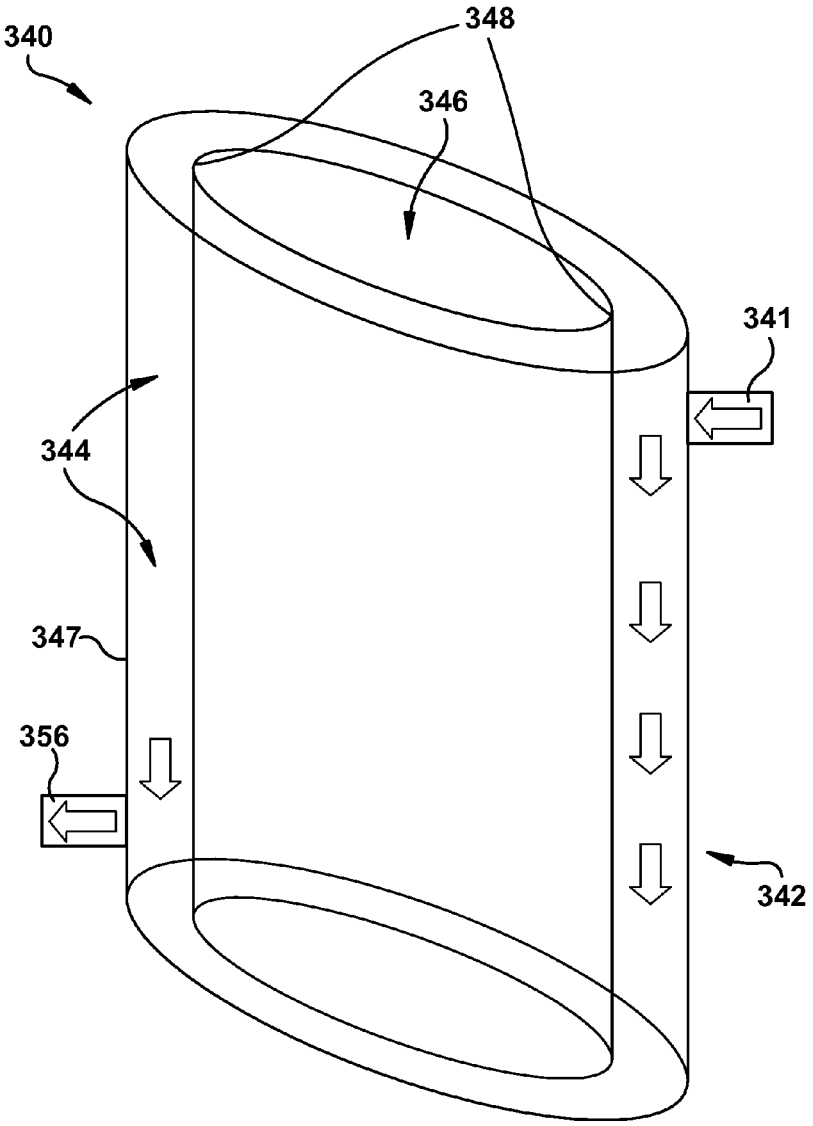
FIG. 3 shows a three-dimensional perspective view of portions of a thermal control system according to an embodiment of the invention.
Figure 4:
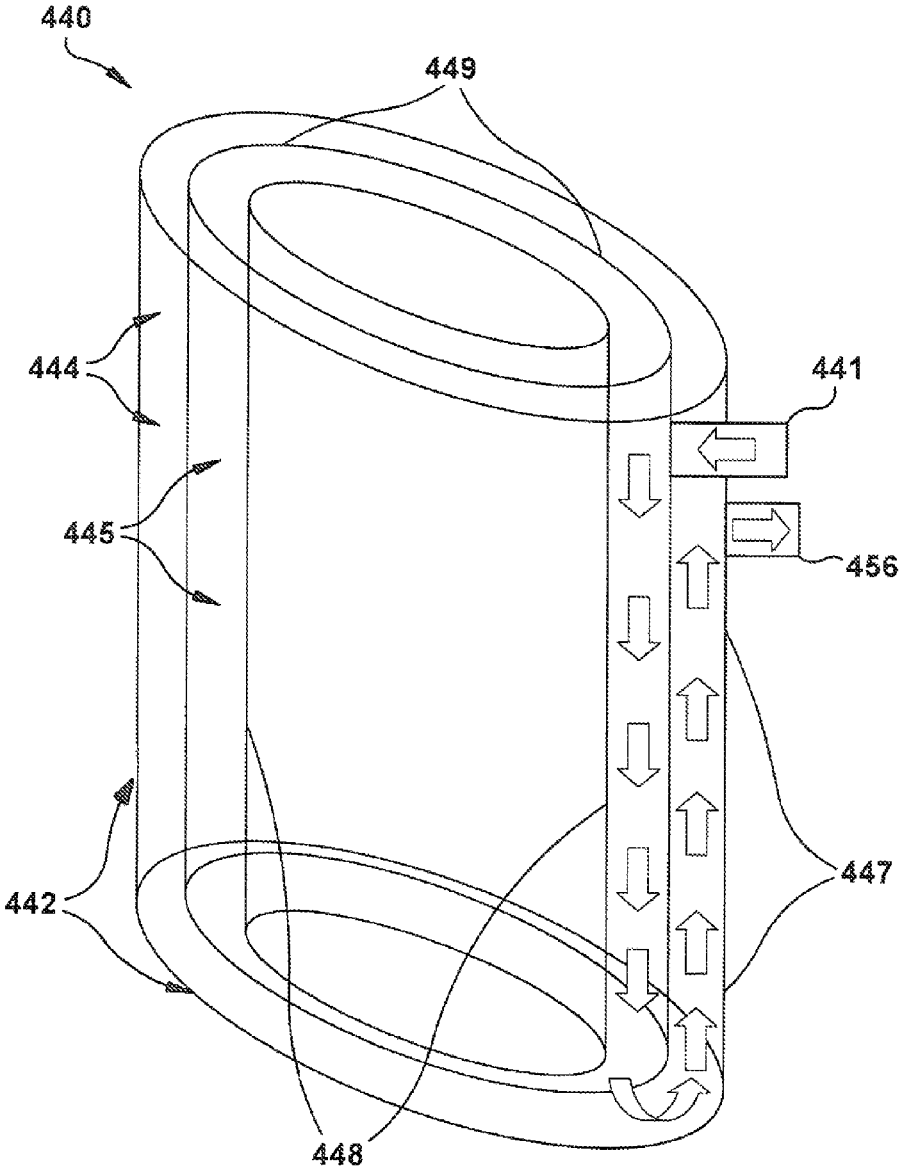
FIG. 4 shows a three-dimensional perspective view of portions of a thermal control system according to an embodiment of the invention.

Turning to FIG. 3, a three-dimensional perspective view of portions of a thermal control system 340 is shown according to embodiments. It is understood that elements similarly numbered between FIG. 2 and FIG. 3 may be substantially similar as described with reference to FIG. 2. Further, in embodiments shown and described with reference to FIGS. 1-7, like numbering may represent like elements. Redundant explanation of these elements has been omitted for clarity. Finally, it is understood that the components of FIGS. 1-7 and their accompanying descriptions may be applied to any embodiment described herein.

Returning to FIG. 3, in this embodiment, thermal control system 340 may include a housing 342 which defines a cavity 346 adapted to substantially complement and/or enclose rotor bearing support 220 (not shown), housing 342 thereby shielding rotor bearing support 220 from environmental conditions. In this embodiment, housing 342 includes an outer wall 347 and an inner wall 348 which define an annular cavity 344. Annular cavity 344 serves as a passage for a thermal fluid entering housing 342 via an inlet 341 and exiting housing 342 via an outlet 356, thereby circulating through thermal control system 340. In one embodiment, housing 342 is comprised of carbon steel. In another embodiment, housing 342 is comprised of aluminum. It is understood that housing 342 may be comprised of any material or combination of materials known in the art. In any event, in one embodiment, the thermal fluid is introduced at a temperature below that of environmental conditions, thereby having a cooling effect on housing 342, dissipating heat from thermal control system 340 and thermally insulating bearing support 220. In another embodiment, shown in FIG. 4, a thermal control system 440 includes a housing 442 with an outer wall 447, a first inner wall 448, and a second inner wall 449. Second inner wall 449 and first inner wall 448 substantially defining a first annular cavity 445 which is fluidly connected to a second annular cavity 444 substantially defined by outer wall 447 and second inner wall 449. A thermal fluid enters first annular cavity 445 via an inlet 441 which is fluidly connected to first annular cavity 445. The thermal fluid flows through first annular cavity 445 and into second annular cavity 444 where the thermal fluid may be removed from housing 442 via an outlet 456.

Figure 5:
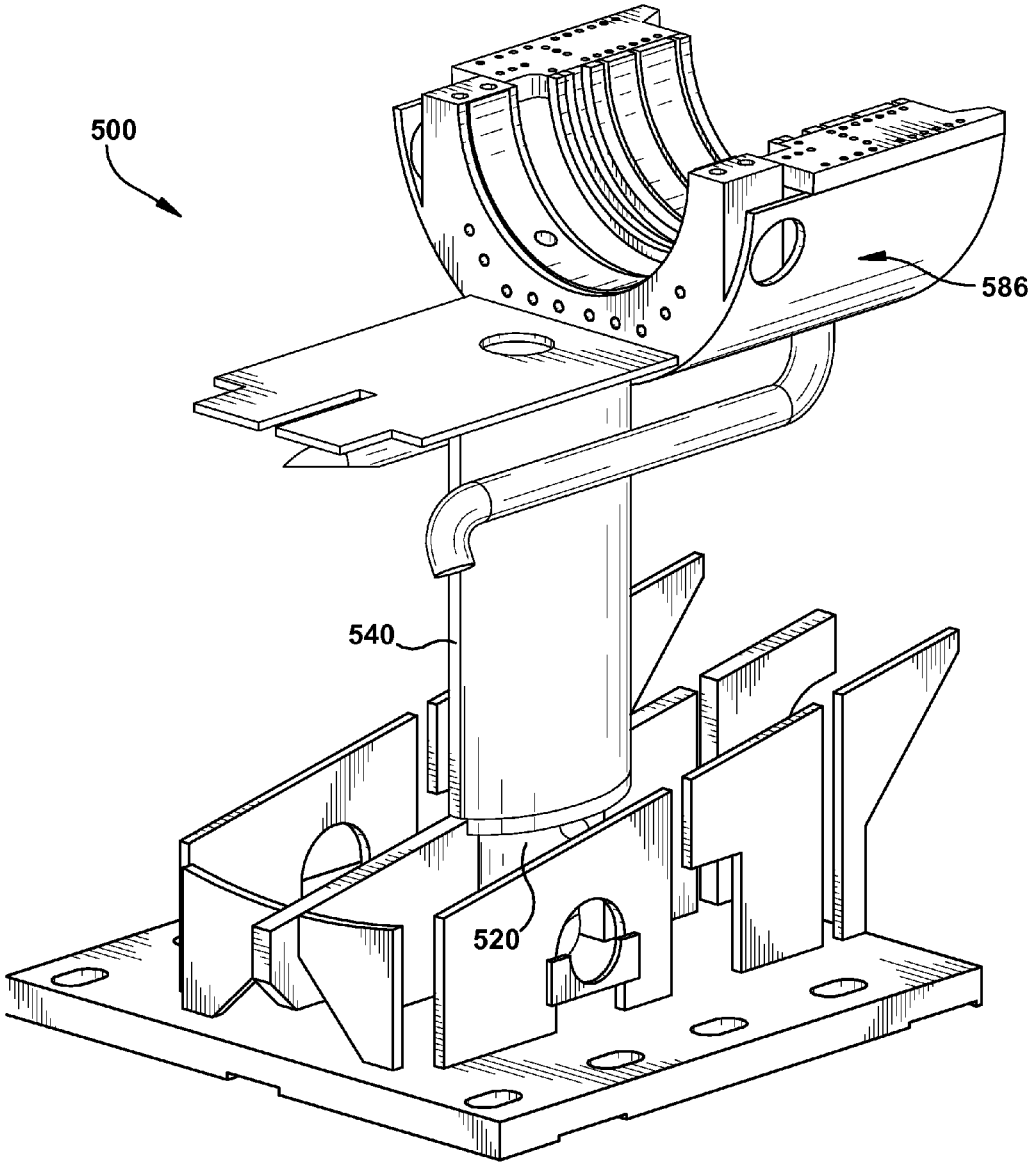
FIG. 5 shows a three-dimensional perspective view of portions of a turbine according to an embodiment of the invention.

Turning to FIG. 5, a partial three-dimensional perspective view of portions of a turbine 500 is shown according to embodiments. In this embodiment, a rotor bearing system 586 is supported by a rotor bearing support 520 which is substantially enclosed by a thermal control system 540. Thermal control system 540 is adapted to shield rotor bearing support 520 from environmental conditions. In one embodiment, thermal control system 540 is adapted to regulate a position of rotor bearing system 586 by thermally regulating rotor bearing support 520, thereby controlling the expansion and contraction of rotor bearing support 520.

Figure 6:
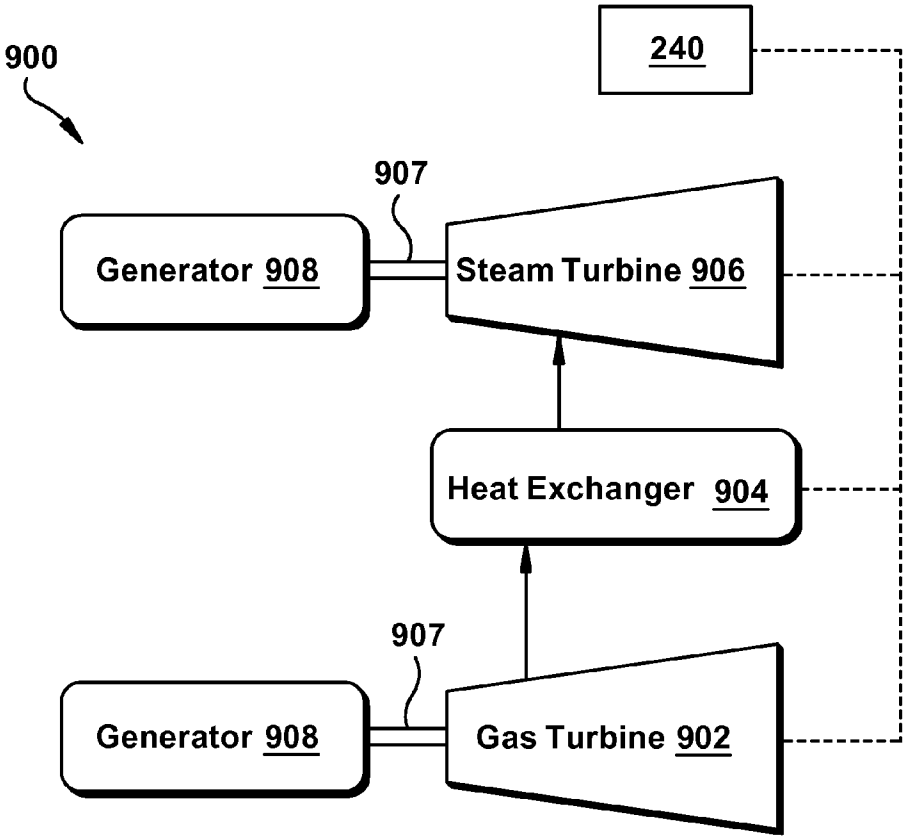
FIG. 6 shows a schematic view of portions of a multi-shaft combined cycle power plant in accordance with an aspect of the invention.
Figure 7:
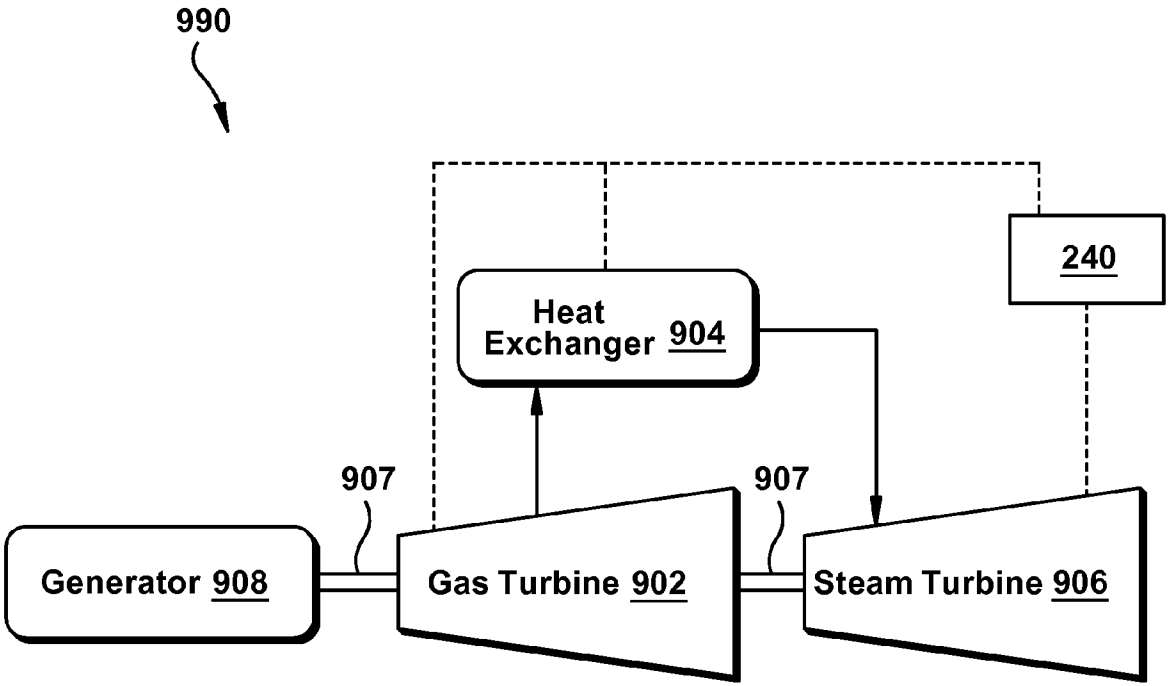
FIG. 7 shows a schematic view of a single shaft combined cycle power plant in accordance with an aspect of the invention.

Turning to FIG. 6, a schematic view of portions of a multi-shaft combined cycle power plant 900 is shown. Combined cycle power plant 900 may include, for example, a gas turbine 902 operably connected to a generator 908. Generator 908 and gas turbine 902 may be mechanically coupled by a shaft 907, which may transfer energy between a drive shaft (not shown) of gas turbine 902 and generator 908. Also shown in FIG. 6 is a heat exchanger 904 operably connected to gas turbine 902 and a steam turbine 906. Heat exchanger 904 may be fluidly connected to both gas turbine 902 and a steam turbine 906 via conventional conduits (numbering omitted). Gas turbine 902 and/or steam turbine 906 may be fluidly connected to thermal control system 240 of FIG. 2 or other embodiments described herein. Heat exchanger 904 may be a conventional heat recovery steam generator (HRSG), such as those used in conventional combined cycle power systems. As is known in the art of power generation, HRSG 904 may use hot exhaust from gas turbine 902, combined with a water supply, to create steam which is fed to steam turbine 906. Steam turbine 906 may optionally be coupled to a second generator system 908 (via a second shaft 907). It is understood that generators 908 and shafts 907 may be of any size or type known in the art and may differ depending upon their application or the system to which they are connected. Common numbering of the generators and shafts is for clarity and does not necessarily suggest these generators or shafts are identical. In one embodiment (shown in phantom), thermal control system 240 may receive a fluid from HRSG 904. In another embodiment, thermal control system 240 may receive a fluid from steam turbine 906. In one embodiment of the present invention (shown in phantom), thermal control system 240 receives a fluid from fluid system 252 (shown in FIG. 2). Fluid system 252 may include a compressor, pressurized gas source or other fluid source as is known in the art. In another embodiment (shown in phantom), thermal control system 240 may receive a fluid in the form of compressed air generated from the operation of gas turbine 902. In another embodiment, steam turbine 906 may be fluidly integrated with thermal control system 240. In another embodiment, shown in FIG. 7, a single shaft combined cycle power plant 990 may include a single generator 908 coupled to both gas turbine 902 and steam turbine 906 via a single shaft 907. Steam turbine 906 and/or gas turbine 902 may be fluidly connected to thermal control system 240 of FIG. 2 or other embodiments described herein.

The thermal control system of the present disclosure is not limited to any one particular turbine, power generation system or other system, and may be used with other power generation systems and/or systems (e.g., combined cycle, simple cycle, nuclear reactor, etc.). Additionally, the thermal control system of the present invention may be used with other systems not described herein that may benefit from the thermal protection of the thermal control system described herein.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A thermal control system for rotor bearing supports, the thermal control system comprising:

a housing fluidly connected to an inlet and adapted to substantially enclose a first rotor bearing support, the housing defining a first annular cavity adapted to receive a fluid from the inlet;

an outlet fluidly connected to the housing, the outlet adapted to receive the fluid from the annular cavity;

a second rotor bearing support positioned axially upstream of the first rotor bearing support;

a sensor connected to the second rotor bearing support, the sensor adapted to monitor a condition of the second rotor bearing support; and a fluid system connected to the sensor and adapted to supply the fluid to the inlet, the fluid system adapted to adjust a temperature of the fluid based upon the condition of the second rotor bearing support.

2. The thermal control system of claim 1, wherein the fluid system is fluidly connected to the inlet.

3. The thermal control system of claim 1, wherein the housing further defines a second annular cavity fluidly connected to the first annular cavity.

4. The thermal control system of claim 1, wherein the housing is adapted to enclose the rotor bearing support.

5. The thermal control system of claim 1, wherein the fluid is selected from a group consisting of: condensate, lube oil, steam, or water.

6. A steam turbine comprising:

a stator;

a rotor enclosed within the stator;

a set of rotor bearings connected to the rotor;

a first rotor bearing support connected to a first portion of the set of rotor bearings;

a second rotor bearing support positioned axially upstream of the first rotor bearing support and connected to a second portion of the set of rotor bearings; and a thermal control system connected to the set of rotor bearing supports, the thermal control system comprising:

an inlet;

a housing fluidly connected to the inlet and adapted to substantially enclose the first rotor bearing support, the housing defining a first annular cavity adapted to receive a fluid from the inlet;

an outlet fluidly connected to the housing, the outlet adapted to receive the fluid from the annular cavity;

a sensor connected to the second rotor bearing support, the sensor adapted to monitor a condition of the second rotor bearing support; and a fluid system connected to the sensor and adapted to supply the fluid to the inlet, the fluid system adapted to adjust a temperature of the fluid based upon the condition of the second rotor bearing support.

7. The steam turbine of claim 6, wherein the fluid system is fluidly connected to the inlet.

8. The steam turbine of claim 6, wherein the housing further defines a second annular cavity fluidly connected to the first annular cavity.

9. The steam turbine of claim 6, wherein the fluid is selected from a group consisting of: condensate, lube oil, steam, or water.

10. A power generation system comprising:

a generator;

a steam turbine operatively connected to the generator;

a rotor disposed within the steam turbine;

a set of rotor bearings connected to the rotor;

a first rotor bearing support connected to a first portion of the set of rotor bearings;

a second rotor bearing support positioned axially upstream of the first rotor bearing support and connected to a second portion of the set of rotor bearings; and a thermal control system connected to the set of rotor bearing supports, the thermal control system comprising:

an inlet;

a housing fluidly connected to the inlet and adapted to substantially enclose the first rotor bearing support, the housing defining a first annular cavity adapted to receive a fluid from the inlet;

an outlet fluidly connected to the housing, the outlet adapted to receive the fluid from the annular cavity;

a sensor connected to the second rotor bearing support, the sensor adapted to monitor a condition of the second rotor bearing support; and a fluid system connected to the sensor and adapted to supply the fluid to the inlet, the fluid system adapted to adjust a temperature of the fluid based upon the condition of the second rotor bearing support.

11. The power generation system of claim 10, wherein the fluid system is fluidly connected to the inlet.

12. The power generation system of claim 10, wherein the housing further defines a second annular cavity fluidly connected to the first annular cavity.

13. The power generation system of claim 10, wherein the fluid is selected from a group consisting of: condensate, lube oil, steam, or water.

14. The thermal control system of claim 1, wherein the fluid control system adjusts the temperature of the fluid such that a growth of the first rotor bearing support is substantially equal to a growth of the second rotor bearing support.

15. The steam turbine of claim 6, wherein the fluid control system adjusts the temperature of the fluid such that a growth of the first rotor bearing support is substantially equal to a growth of the second rotor bearing support.

16. The power generation system of claim 10, wherein the fluid control system adjusts the temperature of the fluid such that a growth of the first rotor bearing support is substantially equal to a growth of the second rotor bearing support.

* * * * *